US011471019B2

(12) United States Patent
Howard et al.

(10) Patent No.: US 11,471,019 B2
(45) Date of Patent: Oct. 18, 2022

(54) CLEANING DEVICE WITH LIGHTS

(71) Applicant: SharkNinja Operating LLC, Needham, MA (US)

(72) Inventors: Damian Howard, Winchester, MA (US); James P. Bilodeau, Littleton, MA (US); Wei Zhang, Billerica, MA (US); Yu Ri Young Kim, Brighton, MA (US)

(73) Assignee: SharkNinja Operating LLC, Needham, MA (US)

( * ) Notice: Subject to any disclaimer, the term of this patent is extended or adjusted under 35 U.S.C. 154(b) by 321 days.

(21) Appl. No.: 16/791,223

(22) Filed: Feb. 14, 2020

(65) Prior Publication Data

US 2021/0251453 A1 Aug. 19, 2021

(51) Int. Cl.
*A47L 11/40* (2006.01)
*A47L 11/04* (2006.01)
(Continued)

(52) U.S. Cl.
CPC ..... *A47L 11/4008* (2013.01); *A47L 11/04* (2013.01); *A47L 11/201* (2013.01); *A47L 13/16* (2013.01)

(58) Field of Classification Search
CPC ..... A47L 11/40; A47L 13/20; A47L 13/256
See application file for complete search history.

(56) References Cited

U.S. PATENT DOCUMENTS 490,472 A 1/1893 Clements
D117,388 S 10/1939 Woinarovicz
(Continued)

FOREIGN PATENT DOCUMENTS

CN 103356140 A 10/2013
CN 205181229 U 4/2016
(Continued)

OTHER PUBLICATIONS

Amazon.com—Shark Genius Steam Pocket Mop Hard Floor Cleaner, oldest reviews 2016, https://www.amazon.com/Cleaner-Blaster-Technology-Intelligent-S5003D/dp/B01 KU4BSGK/ref=cm_cr arp_d_product_top?ie=UTF8, site visited Oct. 11, 2018.
(Continued)

*Primary Examiner* — Michael D Jennings
(74) *Attorney, Agent, or Firm* — Mintz Levin Cohn Ferris Glovsky and Popeo, PC; Lisa Adams

(57) ABSTRACT

A cleaning device includes a cleaning device body and a replacement head. The cleaning device body includes an elongated handle, a housing and a replacement head mounting section. The replacement head has a pad that is intended to clean a surface, such as a floor and is removably attachable to the cleaning device body. The housing includes a circuit board having at least one sensor capable of sensing motion. The handle includes at least one button that can turn on/off either a vacuum source or a jet nozzle that sprays cleaner fluid. The cleaning device body further includes at least one light mounted thereon. The at least one light is illuminated when the button is pressed and then the at least one light remains illuminated until a predetermined amount of time has passed during which neither the button has not been pressed nor motion sensed by the sensor.

14 Claims, 10 Drawing Sheets

(51) Int. Cl.
*A47L 11/20* (2006.01)
*A47L 13/16* (2006.01)

(56) References Cited

U.S. PATENT DOCUMENTS

| | | | |
|---|---|---|---|
| D214,977 | S | 8/1969 | Roth |
| D247,949 | S | 5/1978 | Tillinghast et al. |
| D250,245 | S | 11/1978 | Bebb |
| D278,099 | S | 3/1985 | Evans |
| 5,365,881 | A | 11/1994 | Sporn |
| 5,664,285 | A | 9/1997 | Melito et al. |
| 5,829,090 | A | 11/1998 | Melito et al. |
| D423,157 | S | 4/2000 | Hodges |
| 6,102,278 | A | 8/2000 | Rothas |
| 6,453,506 | B1 | 9/2002 | Summer |
| 6,571,421 | B1 | 6/2003 | Sham et al. |
| 6,966,098 | B2 | 11/2005 | Sako et al. |
| 7,013,528 | B2 | 3/2006 | Parker et al. |
| 7,048,804 | B2 | 5/2006 | Kisela et al. |
| 7,137,169 | B2 | 11/2006 | Murphy et al. |
| 7,150,069 | B2 | 12/2006 | Hori et al. |
| D548,907 | S | 8/2007 | Killen |
| 7,293,322 | B2 | 11/2007 | Matousek et al. |
| 7,329,294 | B2 | 2/2008 | Conrad |
| 7,337,494 | B2 | 3/2008 | Baer et al. |
| 7,409,745 | B2 | 8/2008 | Dodson et al. |
| D597,717 | S | 8/2009 | Rosenzweig et al. |
| 7,673,361 | B2 | 3/2010 | Policicchio et al. |
| 7,676,877 | B2 | 3/2010 | Policicchio et al. |
| 7,861,351 | B2 | 1/2011 | Ho |
| 7,934,287 | B2 | 5/2011 | De Soto-Burt et al. |
| 8,020,236 | B2 | 9/2011 | Kaleta et al. |
| 8,065,778 | B2 | 11/2011 | Kim et al. |
| D661,034 | S | 5/2012 | Ediger et al. |
| D672,107 | S | 12/2012 | Van Landingham, Jr et al. |
| 8,341,802 | B2 | 1/2013 | Kim et al. |
| 8,458,850 | B2 | 6/2013 | Kasper et al. |
| 8,495,781 | B2 | 7/2013 | Dingert |
| D703,407 | S | 4/2014 | Xiong |
| D731,137 | S | 6/2015 | Colangelo |
| D764,127 | S | 8/2016 | Vicari et al. |
| D766,584 | S | 9/2016 | Blouin et al. |
| 9,504,366 | B2 | 11/2016 | Kasper et al. |
| 9,661,968 | B2 | 5/2017 | Bradbury |
| D804,123 | S | 11/2017 | Orsino |
| 9,901,231 | B2 | 2/2018 | Tibberts |
| D817,574 | S | 5/2018 | Libman et al. |
| 2003/0159230 | A1 | 8/2003 | Oh |
| 2004/0045126 | A1 | 3/2004 | Parker et al. |
| 2004/0134016 | A1 | 7/2004 | Kisela et al. |
| 2004/0134025 | A1 | 7/2004 | Murphy et al. |
| 2004/0141798 | A1 | 7/2004 | Garabedian, Jr. et al. |
| 2005/0115409 | A1 | 6/2005 | Conrad |
| 2005/0193516 | A1 | 9/2005 | Hughes |
| 2007/0245511 | A1 | 10/2007 | Hahm et al. |
| 2009/0271935 | A1* | 11/2009 | Kim ..... A47L 11/284 15/22.1 |
| 2010/0024156 | A1 | 2/2010 | De Soto-Burt et al. |
| 2010/0024157 | A1 | 2/2010 | Vernon et al. |
| 2010/0115719 | A1 | 5/2010 | West et al. |
| 2012/0311813 | A1 | 12/2012 | Gilbert, Jr. et al. |
| 2013/0055521 | A1 | 3/2013 | Lee et al. |
| 2014/0033470 | A1 | 2/2014 | Codling |
| 2014/0033471 | A1 | 2/2014 | Toole et al. |
| 2016/0022111 | A1 | 1/2016 | Scolari |
| 2016/0174793 | A1 | 6/2016 | Burke et al. |
| 2017/0007086 | A1 | 1/2017 | Kleine-Doepke et al. |
| 2017/0202421 | A1 | 7/2017 | Hwang et al. |
| 2018/0035855 | A1 | 2/2018 | Wood |
| 2018/0055315 | A1 | 3/2018 | Conrad |
| 2018/0177367 | A1 | 6/2018 | Amaral et al. |
| 2018/0220861 | A1 | 8/2018 | Zhang et al. |
| 2018/0360290 | A1 | 12/2018 | Perry et al. |
| 2019/0075984 | A1 | 3/2019 | James et al. |
| 2019/0274496 | A1 | 9/2019 | James et al. |
| 2019/0274497 | A1 | 9/2019 | James et al. |
| 2019/0274498 | A1 | 9/2019 | James et al. |
| 2019/0282045 | A1 | 9/2019 | James et al. |
| 2020/0046196 | A1 | 2/2020 | Weeks et al. |
| 2021/0076896 | A1* | 3/2021 | Milanese ..... A47L 13/225 |

FOREIGN PATENT DOCUMENTS

| | | | |
|---|---|---|---|
| EP | 1027844 | A2 | 8/2000 |
| JP | 2006198083 | A | 8/2006 |
| JP | D1489801 | S | 2/2014 |
| KR | 20170043227 | A | 4/2017 |
| WO | 2004062454 | A2 | 7/2004 |
| WO | 2004062457 | A2 | 7/2004 |
| WO | 2005018402 | A2 | 3/2005 |
| WO | 2009111770 | A1 | 9/2009 |
| WO | 2010014366 | A1 | 2/2010 |
| WO | 2010014367 | A1 | 2/2010 |
| WO | 2011017493 | A1 | 2/2011 |
| WO | 2011112545 | A2 | 9/2011 |
| WO | 2014020303 | A1 | 2/2014 |
| WO | 2014104503 | A1 | 7/2014 |
| WO | 2016022270 | A1 | 2/2016 |
| WO | 2016062647 | A1 | 4/2016 |
| WO | 2016095040 | A1 | 6/2016 |
| WO | 2016100964 | A2 | 6/2016 |
| WO | 2019051431 | A1 | 3/2019 |

OTHER PUBLICATIONS

International Search Report; Application No. PCT/US2018/050308; dated Nov. 26, 2018; 3 pages.

* cited by examiner

CLEANING DEVICE WITH LIGHTS

FIELD OF THE INVENTION

The present disclosure relates generally to cleaning devices, and more specifically to a cleaning device with lights.

BACKGROUND

Hardfloor cleaning can be challenging when there are a variety of mixed media debris present. In some instances, there is a desire to both vacuum dry, loose debris, scrub stuck debris and absorb any wet debris that may be present. Prior art tools, such as vacuums, dry mops and wet mops are capable of handling some of these types of media, but not all at once. As a result, many often sweep dry debris before mopping wet or stuck-on debris. In many cases, it is desirable for the cleaning devices to be cordless and, instead, utilize an on-board re-chargeable battery.

Known tools that can handle both dry and wet media have higher set-up times than a broom/mop combination and the after-use maintenance can be especially high when liquids are involved. If the combination tool is not properly cleaned after each use, they can become smelly and unpleasant. Lastly, clean up can be quite messy and the user may be required to either dirty his or her hands and/or wear gloves.

In addition, in many instances, the cleaning process requires cleaning in areas of a room that are typically underlit or dark. For example, the area under furniture and in the corners of a room are typical areas that are frequently vacuumed or mopped, but that are not well-lit.

Therefore, an improved cleaning device body that includes on-board lights is desired.

SUMMARY

The cleaning device of the present invention includes a cleaning device body and a replacement head. The cleaning device body includes an elongated handle, a housing and a replacement head mounting section. The replacement head having a pad that defines a first surface and a second surface, the second surface is intended to be brought into contact with a surface (e.g., the floor) that is to be cleaned. The housing includes a circuit board having at least one sensor capable of sensing motion of the cleaning device body, and at least one portable power source that is in electrical communication with the circuit board. The elongated handle includes at least one button that is in electrical communication with the circuit board. The cleaning device body further includes at least one light mounted thereon, the light(s) also being in electrical communication with the circuit board. The replacement head is removably attached to mounting section of the cleaning device body. The at least one light is illuminated when the button is pressed. Then the at least one light remains illuminated until a predetermined amount of time has passed during which neither the button has not been pressed nor motion sensed by the sensor. The predetermined amount of time that the light remains illuminated is preferably between 1 and 300 seconds. More preferably, the predetermined amount of time that the light remains illuminated is preferably between 5 and 120 seconds. Most preferably, the predetermined amount of time that the light remains illuminated is preferably between 10 and 60 seconds.

According to another aspect of the invention, the cleaning device body includes at least two lights.

According to a further aspect of the invention, the mounting section is separated from the housing and elongated handle by a joint that permits the mounting section to pivot relative to the housing.

According to an even further aspect of the invention, the light(s) are mounted on the mounting section and generally directed towards the front of the cleaning device.

According to an even further aspect of the invention, the sensor is selected from one of a vibration sensor, an accelerometer, and a gyroscope.

According to an even further aspect of the invention, the cleaning device body includes a vacuum source that is also powered by the portable power source and activated by a button.

According to an even further aspect of the invention, the cleaning device body includes a reservoir that holds a cleaning solution, a jet nozzle in fluid communication with the reservoir, and a second button that allows a user to selectively spray cleaning solution from the jet nozzle.

According to an even further aspect of the present invention, the replacement head also includes a dust bin capable of storing dust and debris, as well as a filter that is positioned between the dust bin and the vacuum source.

According to an even further aspect of the present invention, the pad includes at least two layers, and at least one layer is at least partially formed from a non-woven material.

One advantage of the present invention is that the lights will turn on simultaneously with an activity that requires a direct user input (e.g., pressing a button to operate the vacuum or jet nozzle) that is typically performed at the beginning of a cleaning operation.

Another advantage of the present invention is that the lights will turn off automatically shortly after the cleaning activity without further action by the user, thereby preserving the energy stored in the portable power supply.

A further advantage of the present invention is that the lights will not constantly turn on and off during normal operation of the cleaning device.

An even further advantage of the present invention is that the lights will not turn on prior to an active user input (e.g., pressing a button) indicating the start of a cleaning process. For example, the lights will not turn on and use battery power when the cleaning device is in transport, despite the motion sensor sensing motion.

An even further advantage of the present invention is that the lights will not turn off simply because a button has not been pressed. The light(s) will remain illuminated while the user is, e.g., mopping but not vacuuming or spraying cleaning fluid.

DETAILED DESCRIPTION OF THE INVENTION

Figure 1:
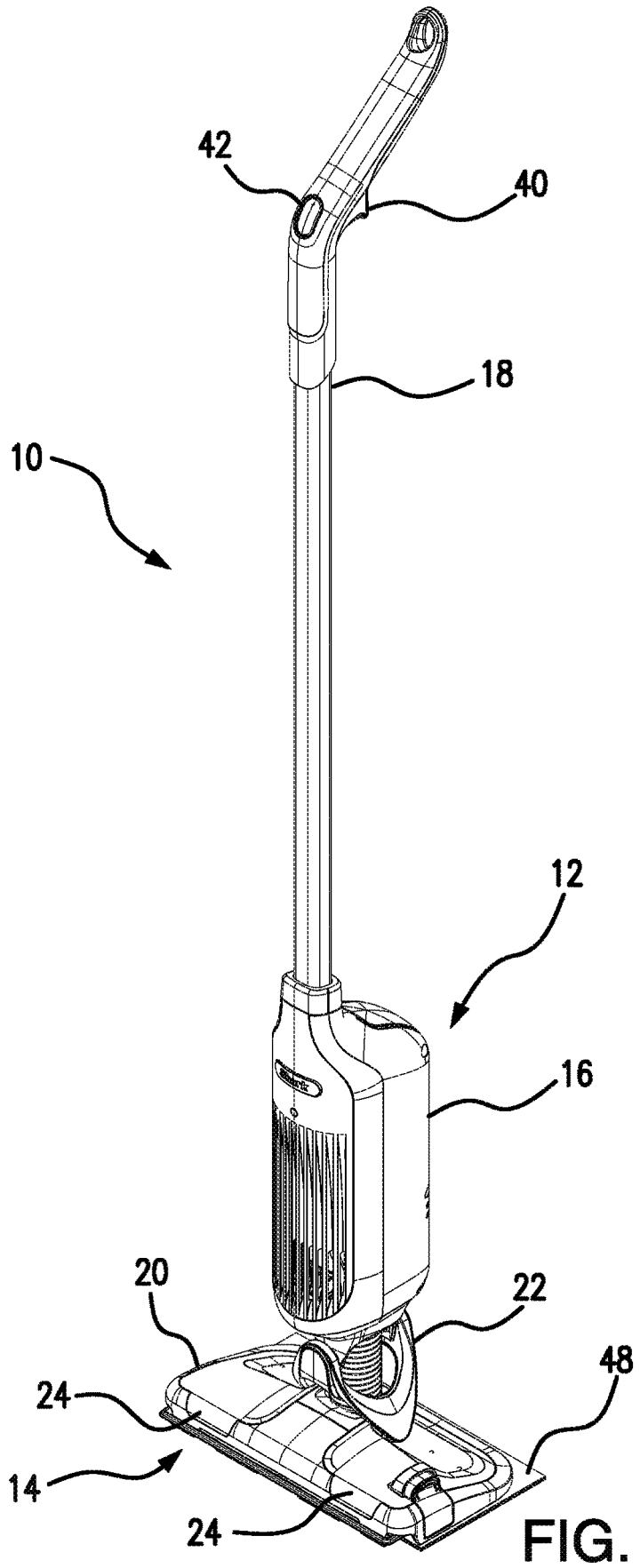
FIG. 1 shows an isometric view of the cleaning device of the present invention.
Figure 2:
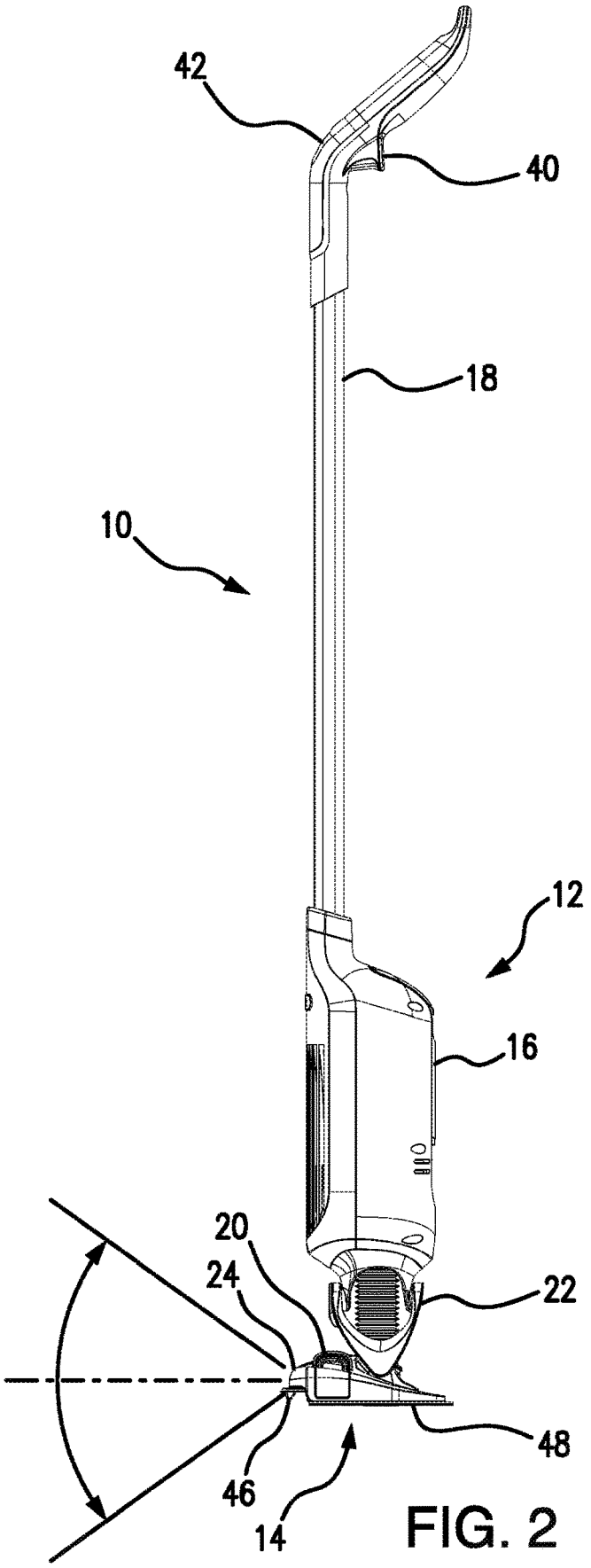
FIG. 2 shows a side view of the cleaning device of the present invention.
Figure 3:
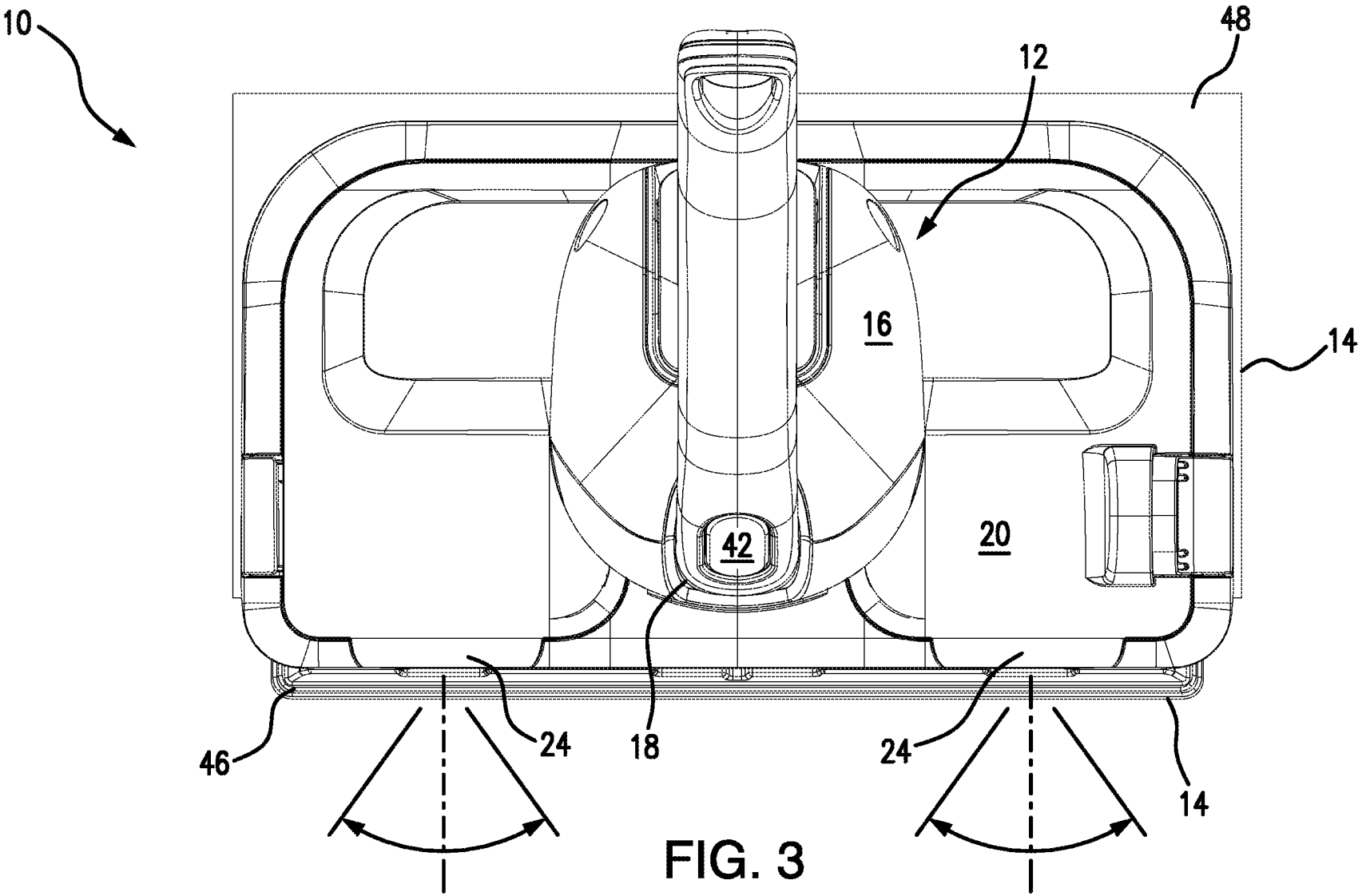
FIG. 3 shows a top view of the cleaning device of the present invention.

FIGS. 1 and 2 illustrate an isometric view and a side view of one embodiment of the cleaning device 10 of the present invention. The cleaning device, as shown, includes a cleaning device body 12 and a replacement head 14.

Referring to FIGS. 1 and 2, the cleaning device body includes a housing 16 for componentry, an elongated handle 18, and a mounting area 20 for a replacement head 14. In the embodiment shown, the mounting area 20 for the replacement head 14 is separated from the housing 16 and elongated handle 18 by a universal joint 22.

Referring now to FIGS. 1, 3, 5 and 6, one or more lights 24 are mounted on the cleaning device body 12. Any type of suitable light source may be utilized; however, LED lights have been shown to have particular utility because they are relatively inexpensive, provide a significant illumination, and do not utilize an excessive amount of energy to illuminate. In some embodiments, numerous LED lights (e.g., 2-20) may be included the design depending on the selection of the light, and the amount of illumination desired during use. One commercially available light 24 that is suitable for the present application is manufactured by Yinghe Optoelectronic (Shanghai) Co., Ltd. with the manufacturer part no. INH-PA3014CW-Z29.

While the light(s) 24 are shown located on the mounting section, the lights can be located at the discretion of the designer anywhere on the cleaning device body. Referring to FIGS. 1, 2, 3 and 6, lights are shown on front portion of a mounting section 20 portion of the to the left and right of the center of the vacuum. One or more of the light(s) 24 can be angled between −30 degrees and +30 degrees relative to horizontal when the cleaning device is positioned flat on a horizontal surface depending on the light pattern that is desired (see FIG. 2). Additionally, the light(s) may be mounted such that they illuminate in a direction that is between −30 degrees and +30 degrees relative to straight forward of the vacuum (see FIG. 3). In embodiments where multiple lights 24 are utilized, a light 24 may point in generally the same direction as another light 24, or it may point in a direction independent of other light 24.

Figure 5:
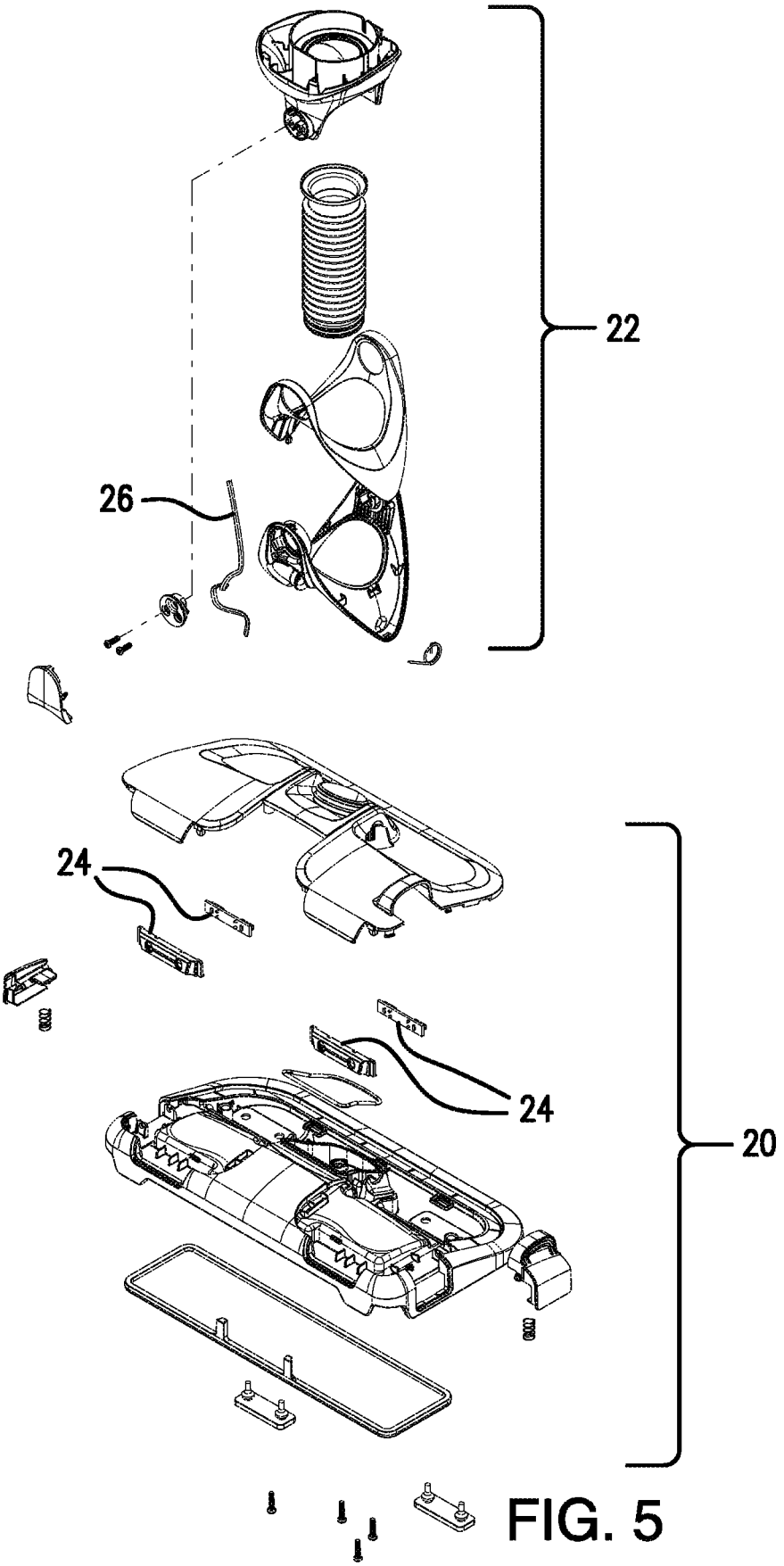
FIG. 5 shows an exploded isometric view of a lower portion of the cleaning device body of FIG. 1.
Figure 6:
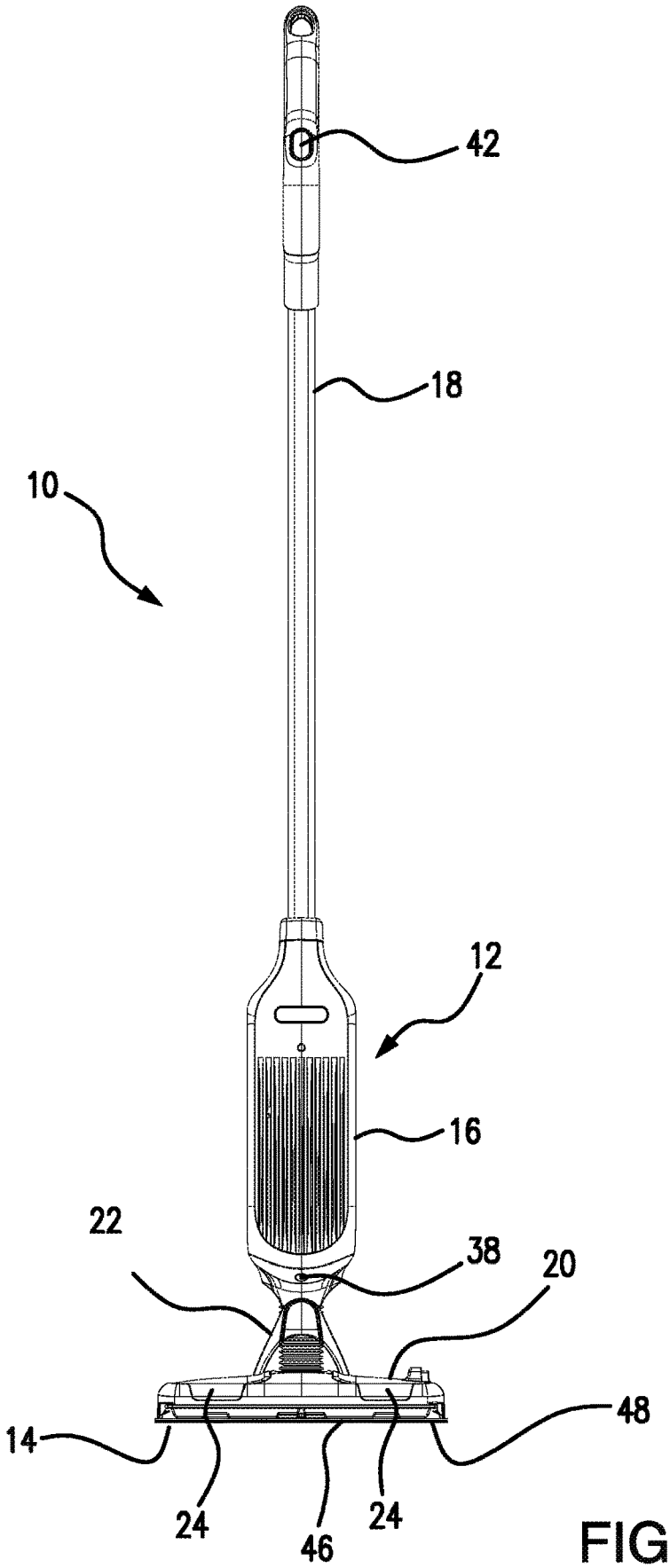
FIG. 6 shows a front view of the cleaning device of the present invention.

Referring to FIG. 5, the lights are electronically connected to the circuit board (described infra.) via a wire 26 that is routed internally in the cleaning device body. As shown in the exploded view, the wire 26 is routed internally through the universal joint 22 inside the molded parts of the cleaning device body 12.

Figure 4:
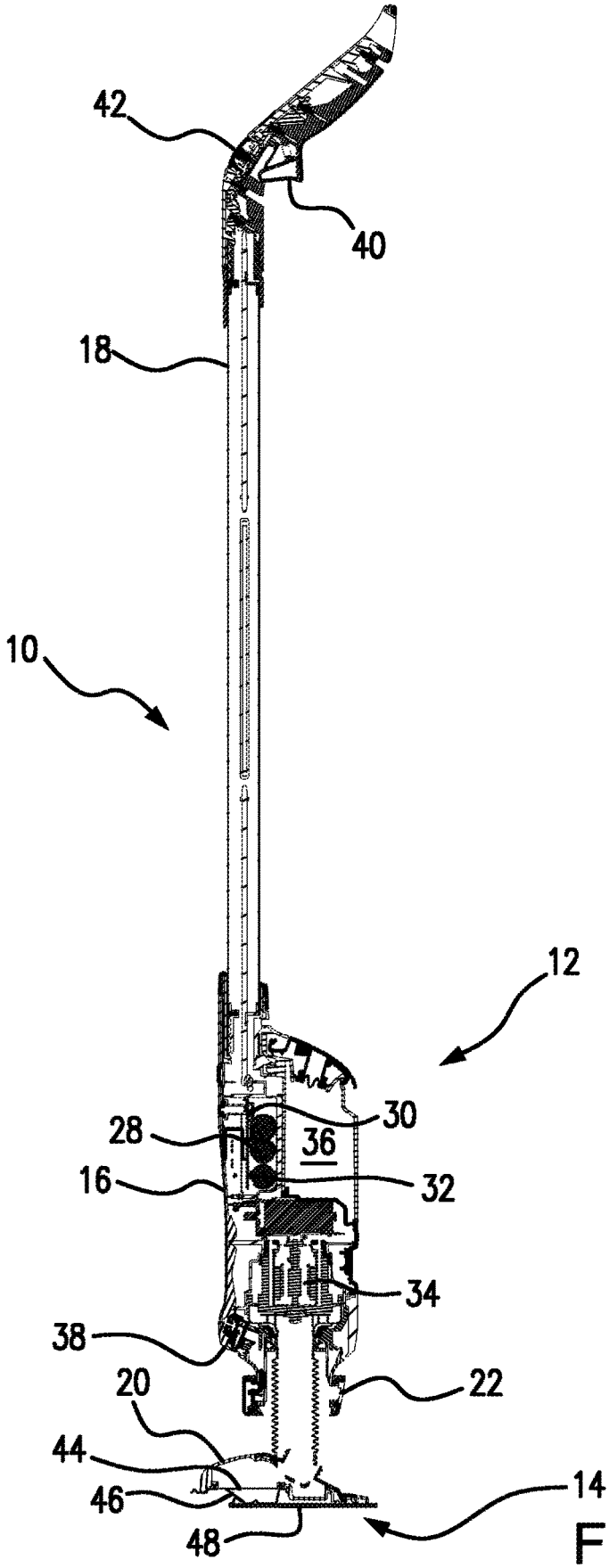
FIG. 4 shows a side cross-sectional view of FIG. 1 along line 4-4.

Referring to FIGS. 1, 2 and 4, the housing 16 includes a portable power source 28, and a circuit board 30. The portable power source 28 (e.g., a rechargeable battery) is in electronic communication with the circuit board 30 and, in the embodiment shown, powers the entire electronic system of the cleaning device 10. As shown in FIG. 4, a single main battery pack is utilized; however, in other embodiments, separate portable power sources 28 may be used to power various operations of the cleaning device 10 without departing from the spirit and scope of the present invention.

The circuit board 30 includes at least one sensor 32 that is capable of sensing motion. In the present application, a vibration sensor is used. Vibration sensors have particular utility in the present application because the are not overly expensive and have a robust design that can operate in diverse environments. One example of a suitable vibration sensor is made by Bai Ling Electronics Co., Ltd. under the manufacturing part no. SW-200D. Alternatively, one of skill in the art would know that accelerometers and gyroscopes could also be utilized as a sensor 32 to detect motion with comparable results.

Referring to FIG. 5, the cleaning device body 12 may also optionally include a vacuum (or suction) source 34 so that the cleaning device 10 can be used as vacuum in addition to as a mop. Further, the cleaning device body 12 can also include a reservoir 36 for a cleaning fluid that is fluid communication with a jet nozzle 38. The reservoir 36 can either hold the cleaning fluid directly, or can hold a container (not shown) that has cleaning fluid therein. The jet nozzle 38 can selectively spray cleaning fluid in a desired direction (e.g., onto the surface directly in front of the replacement head 14 during operation).

Figure 7:
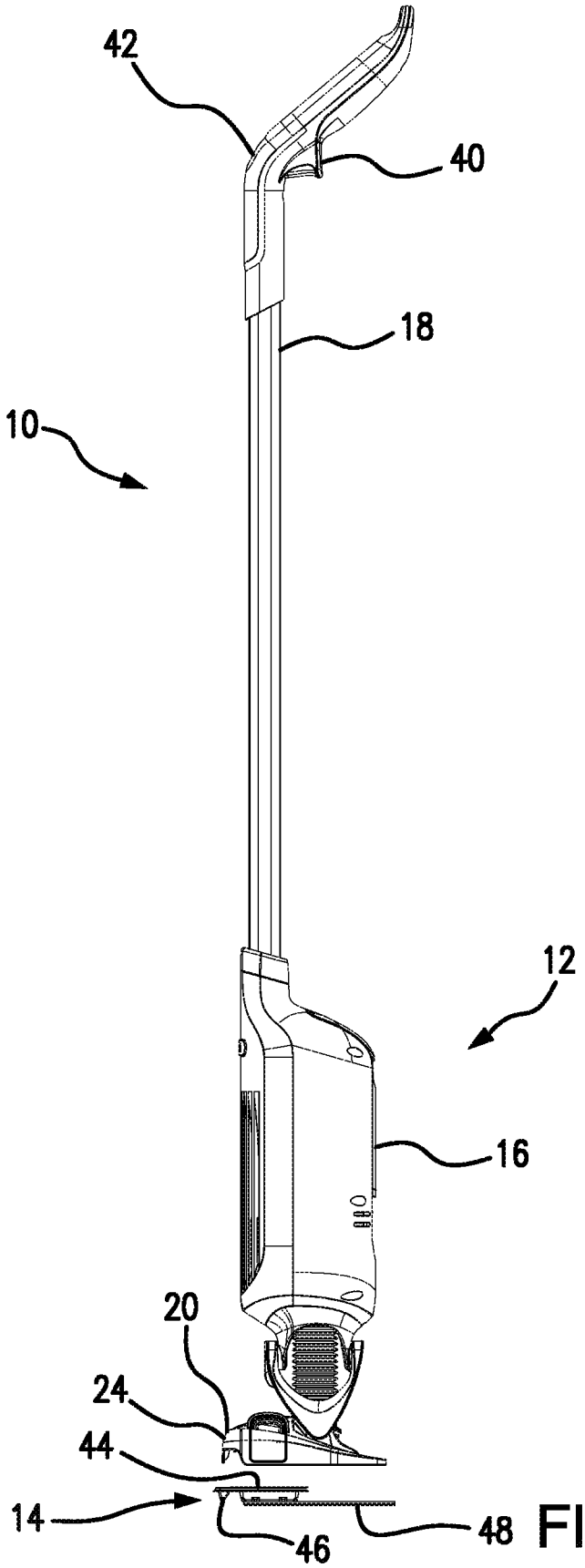
FIG. 7 shows a side view of the cleaning device of the present invention with the replacement head separated from the cleaning device body.

Referring to FIGS. 1, 2 and 7, the cleaning device body 12 has an elongated handle 18 that is preferably ergonomically shaped for ease of use. The elongated handle 18 includes one or more buttons 40, 42. For example, in embodiments, where the cleaning device body 12 includes both a jet nozzle 38 and a vacuum source 34, a dedicated button 40, 42 for each operation is typically provided. Although not shown, a button dedicated for turning on the light(s) 24 is also possible. When a button 40 dedicated to the vacuuming operation is pressed by the user, the vacuum source 34 is activated. When a button 42 dedicated to operation of the jet nozzle 38 is pressed by the user, the jet nozzle 38 is activated and cleaning fluid is sprayed. In the embodiment shown, both buttons 40, 42 are in electronic communication with the circuit board 30. In a preferred embodiment, at least one of the buttons 40,42 is a momentary button or switch. In these embodiments, the cleaning device 10 function activated by the button (e.g., the vacuum source 34 or the jet nozzle 38) only operates while the button 40, 42 is being pressed by the user. The activated function ceases to operate as soon as the user releases pressure from the button 40, 42.

Figure 8:
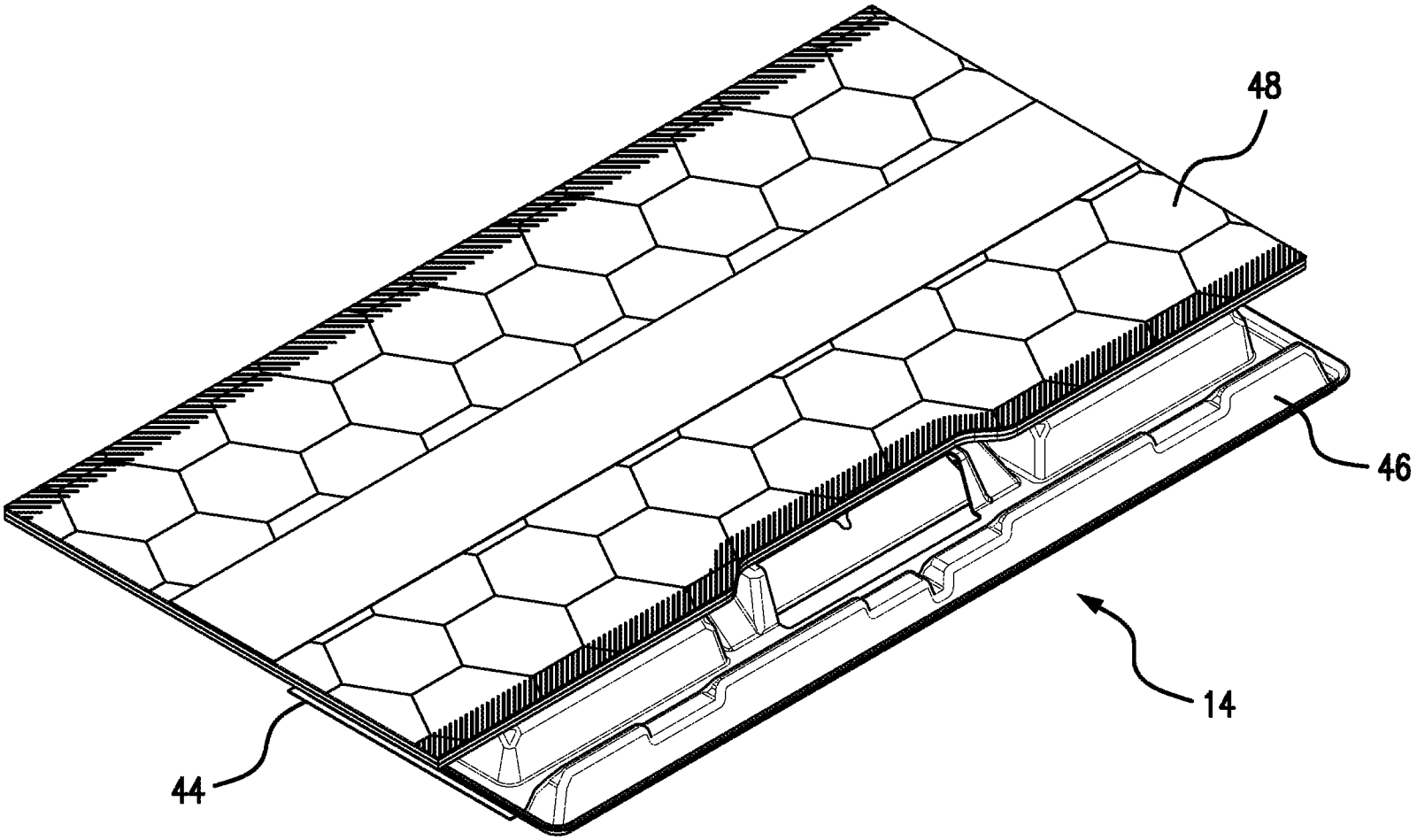
FIG. 8 shows an isometric view of the replacement head generally from the bottom.
Figure 9:
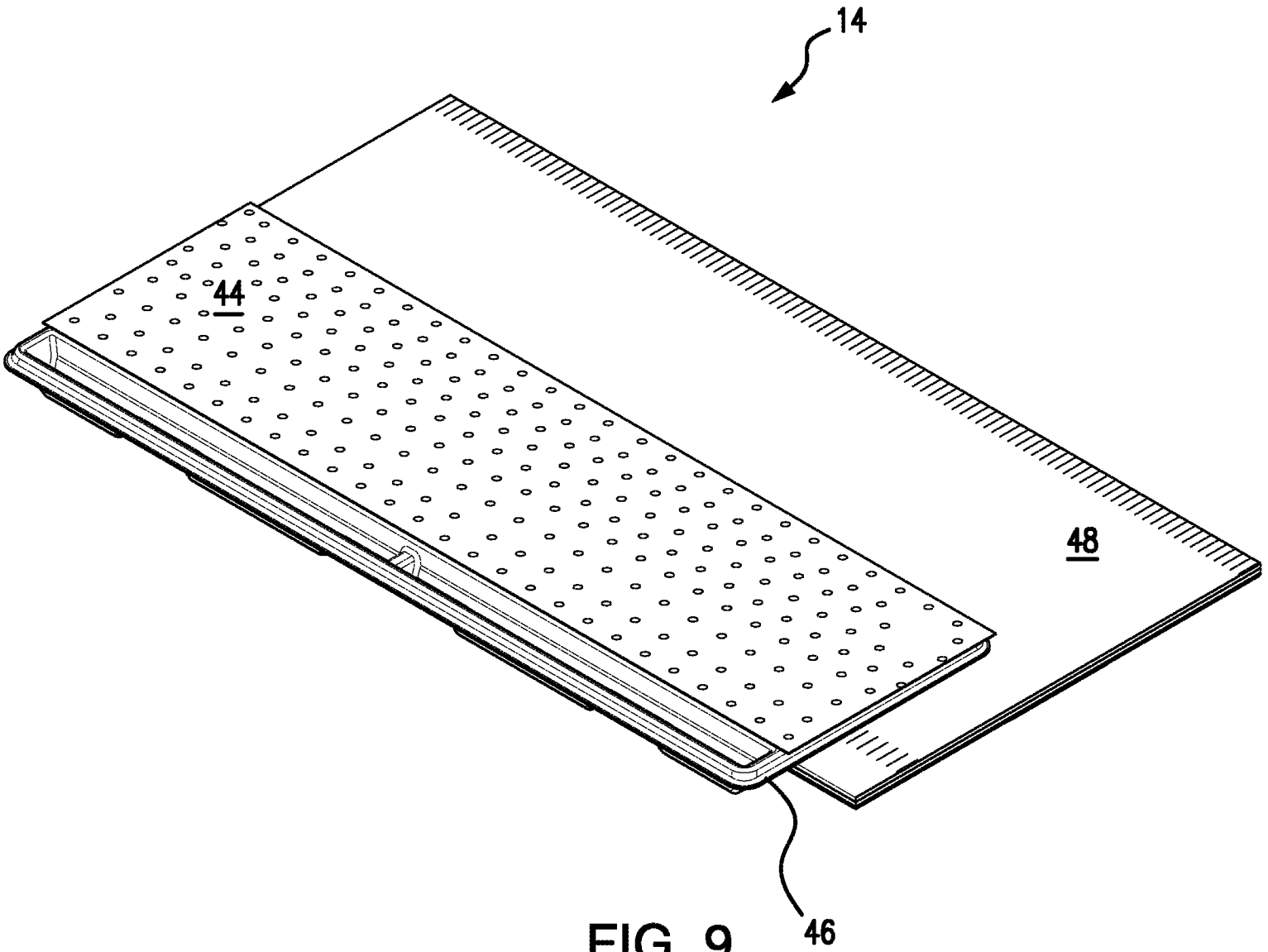
FIG. 9 shows an isometric view of the replacement head of FIG. 8 generally from the top.

Referring to FIGS. 8 and 9, the replacement head 14 includes a filter 44, a plastic tray 46 and a pad 48. The replacement head 14 has been fully described and completely disclosed in U.S. patent application Ser. Nos. 16/670,039, 16/670,103, 16/670,476 and 16/684,465, the contents of each are hereby incorporated herein by reference in their entirety. The replacement head 14 is removably attachable to the cleaning device body 12 by the user using connectors located on the, e.g., plastic tray 46.

Figure 10:
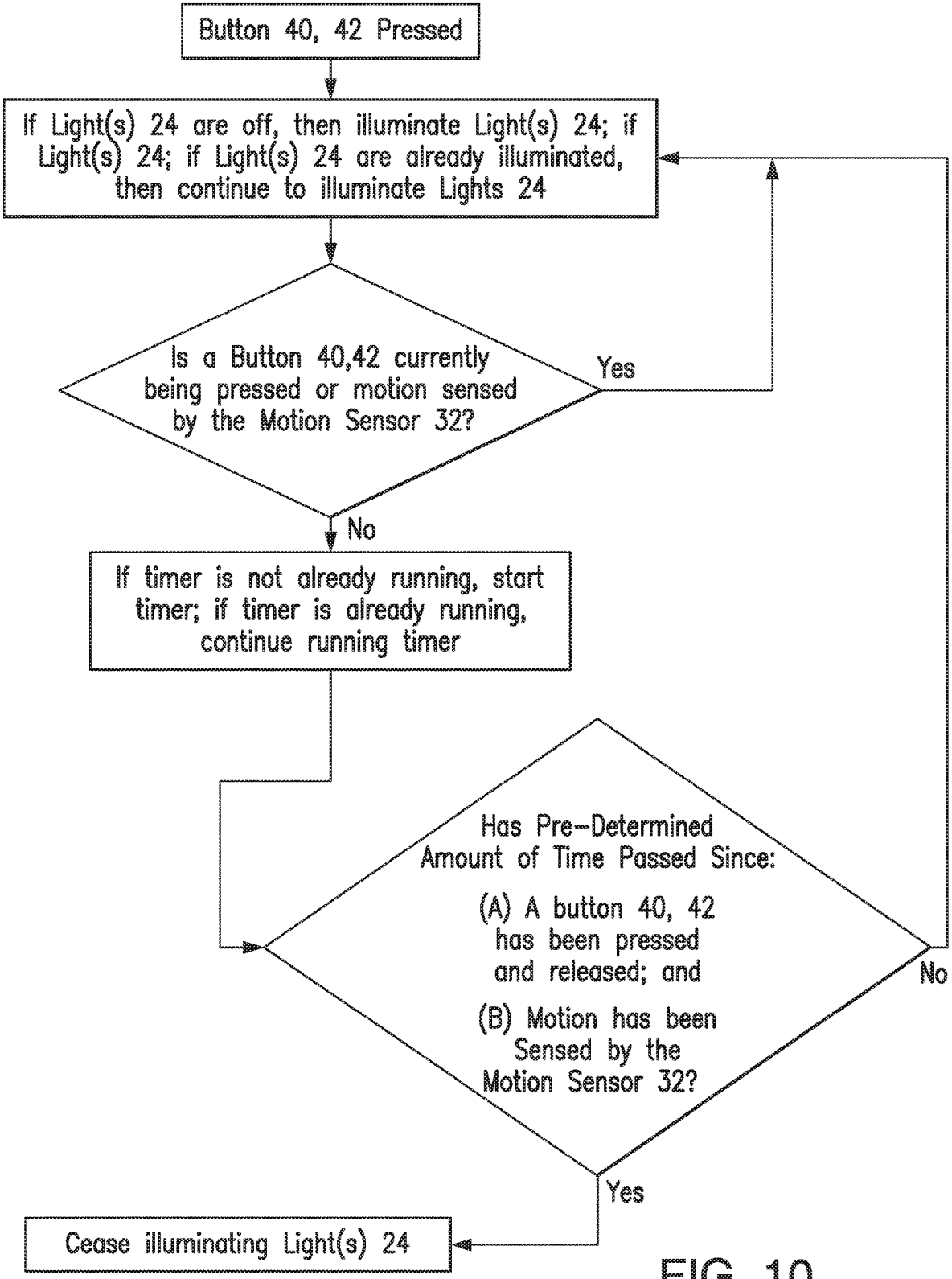
FIG. 10 shows a flowchart of one embodiment of the the algorithm used to determine when the light(s) are illuminated.

The electronic circuitry on the circuit board 30 can be pre-programmed to power the light(s) 24 in any manner using the inputs available (e.g., the motion detector and buttons). Referring to FIG. 10, one preferred manner of operation of the lights 24 is disclosed in the algorithm shown. In the present invention, at least one of the lights 24 is illuminated when any of the buttons 40, 42 is pressed by the user. The pressing of a button 40,42 is a direct user input that indicates that the cleaning process has commenced. Energy from the portable power source 28 is utilized to illuminate the light(s). As vacuuming (or mopping) occurs, the cleaning device 10 is moved about by the user and the motion is detected by the sensor 32. The user may also continuously or repeatedly press either button 40, 42 operate the vacuum source 34 or jet nozzle 38 during the cleaning process. The light(s) 24 remains illuminated until a predetermined amount of time has passed since a button 40, 42 has been pressed or motion sensed by the motion sensor 32. The use of the motion sensor 32 is of particular utility in some embodiments because it enables the system to account for instances when a user utilizes the cleaning device 10 for extended periods of time as a mop without pressing the buttons 40, 42 to operate either the vacuum source 34 or the jet nozzle 38. In these instances, the lights 24 will advantageously remain illuminated even during extended periods of time when the user is moving the cleaning device 10 around, but does not press a button 40, 42. Continuing to refer to FIG. 10, the lights will remain on for a predetermined period of time after the latter of the completion of either of the following events: A) motion of the cleaning device 10 is detected by the motion sensor 32 or B) the release of a button 40,42 after having been pressed. The pre-determined amount of time is preferably between 1 and 300 seconds. More preferably, the pre-determined amount of time is between 5 and 120 seconds. Most preferably, the pre-determined amount of time is between 10 and 60 seconds. By programming the lights 24 to remain on for a short period of time after the cleaning device 10 ceases to be operated will prevent the lights from turning off during normal operation when the user takes a short break during the cleaning process and the cleaning device 10 is neither moved nor a button 40, 42 pressed.

In use, the end user removably connects the replacement head 14 to the cleaning device body 12. The user then activates the vacuum source 34 and/or the jet nozzle 38 to commence the cleaning process. Upon pressing the button, the lights 24 are illuminated. As the user moves the cleaning device 10 over the floor to be cleaned such that the pad 48 cleans the floor, and the suction source 34 draws air, dirt and debris from the area in front of the replacement head 14 into the plastic tray 46. As desired, the user may activate the button 42 on the cleaning device 10 to spray cleaning fluid onto the floor in front of the replacement head 14. The user can then thoroughly clean the floor using the pad 48 to scrub the floor with cleaning fluid and pad 48 material. The lights 24 will remain illuminated until a pre-determined amount of time has passed without the user either depressing one of the buttons 40, 42 or motion of the cleaning device 10 is detected by the sensor 32. When the pre-determined amount of time passes without a button 40, 42 being pressed or motion being detected by the sensor 32, the lights 24 will cease to be illuminated.

One of skill in the art would know that additional embodiments, or variations to the above description can be made without departing from the spirit or scope of the invention. The term "about" is used herein to describe a range of additional values known to one of skill in the art to be equivalent to the stated range. When the term about is used with regard to a range, the term is intended to apply to both ends of the range.

We claim:

1. A cleaning device, comprising:

a cleaning device body that includes an elongated handle, a housing and a replacement head mounting section; and a replacement head having a pad that defines a first surface and a second surface;

wherein the cleaning device body includes a circuit board having at least one sensor capable of sensing motion;

wherein the cleaning device body includes at least one portable power source in electrical communication with the circuit board;

wherein the elongated handle includes at least one button that is in electrical communication with the circuit board;

wherein the cleaning device body further includes at least one light mounted thereon, the at least one light being in electrical communication with the circuit board;

wherein the replacement head is removably attached directly or indirectly to first surface of the pad, and the second surface of the pad is configured to be brought into contact with a surface to be cleaned;

wherein the at least one light is illuminated when the button is pressed and then the at least one light remains illuminated until a predetermined amount of time has passed during which neither the button has not been pressed nor motion sensed by the sensor; and wherein the predetermined amount of time being equal to 1 to 300 seconds.

2. The cleaning device of claim 1, wherein the cleaning device body includes at least two lights.

3. The cleaning device of claim 2, wherein the mounting section is separated from the housing and elongated handle by a joint that permits the mounting section to pivot relative to the housing.

4. The cleaning device of claim 3, wherein at least one of the lights is mounted on the mounting section and generally directed towards the front of the cleaning device.

5. The cleaning device of claim 1, wherein the sensor is selected from one of a vibration sensor, an accelerometer, and a gyroscope.

6. The cleaning device of claim 1, wherein the cleaning device body also includes a vacuum source that is also powered by the portable power source.

7. The cleaning device of claim 6, wherein the cleaning device body further includes a reservoir that holds a cleaning solution, a jet nozzle in fluid communication with the reservoir, and a second button that allows a user to selectively spray cleaning solution from the jet nozzle.

8. The cleaning device of claim 7, wherein the at least one light is turned on when any of the buttons is pressed.

9. The cleaning device of claim 1, wherein the time period that the at least one light remains on is equal to the amount of time that motion is detected by the sensor plus a predetermined amount of time between 5 and 120 seconds.

10. The cleaning device of claim 9, wherein the time period that the at least one light remains on is equal to the amount of time that motion is detected by the sensor plus a predetermined amount of time between 10 and 60 seconds.

11. The cleaning device of claim 1, wherein the replacement head also includes a dust bin capable of storing dust and debris.

12. The cleaning device of claim 11, wherein the replacement head further includes a filter that is positioned between the dust bin and the vacuum source.

13. The cleaning device of claim 1, wherein the pad includes at least two layers and at least one layer is at least partially formed from a non-woven material.

14. The cleaning device of claim 1, wherein at least one of the buttons is a momentary button.

* * * * *